United States Patent [19]

Griffith

[11] Patent Number: 4,843,749

[45] Date of Patent: Jul. 4, 1989

[54] PISTOL BRACE

[75] Inventor: Gene D. Griffith, Miles City, Mont.

[73] Assignee: Pistol Brace, Inc., Miles City, Mont.

[21] Appl. No.: 33,373

[22] Filed: Apr. 2, 1987

[51] Int. Cl.[4] ..... F41C 23/00

[52] U.S. Cl. ..... 42/72; 42/94

[58] Field of Search ..... 42/94, 1.09, 52, 71.01, 42/72; 135/66; 248/118, 155; D3/7

[56] References Cited

U.S. PATENT DOCUMENTS

| | | | |
|---|---|---|---|
| D. 261,199 | 10/1981 | Dockery | D3/7 |
| 1,111,905 | 9/1914 | Keeran | 42/72 |
| 1,497,794 | 6/1924 | Saunders | 42/94 |
| 3,162,966 | 12/1964 | La Coss | 42/71.02 |
| 3,324,588 | 6/1967 | Gilbert | 42/71.01 |
| 3,544,051 | 12/1970 | Norman | 248/155 |
| 3,609,902 | 10/1971 | Casull | 42/72 X |
| 4,118,880 | 10/1978 | Vickers et al. | 42/94 |
| 4,481,964 | 11/1984 | Minneman | 135/66 |

OTHER PUBLICATIONS

Stein, K., *Canes & Walking Sticks,* Liberty Cap Books, New York, 1974.

"Uni-Line Ortho Cane", Lumex Product Literature, Lumex, Inc., 100 Spence St., Bay Shore, N.Y., 1985.

*Primary Examiner*—Deborah L. Kyle
*Assistant Examiner*—Richard W. Wendtland
*Attorney, Agent, or Firm*—Sughrue, Mion, Zinn, Macpeak, and Seas

[57] ABSTRACT

A pistol brace comprising: a first looped portion positioned under the shoulder of a shooter; a hooked portion a distance from the first looped portion for positioning against the shoulder of a shooter; a second elevated looped portion forward of the first looped portion for resting on the forearm of a shooter; a third looped portion forward of the first and second looped portions for supporting the left hand of a shooter whereby the right wrist of the shooter rests on the left wrist in a fashion that provides a rigid support for a pistol in the right hand of the shooter; and a horizontal distal end parallel with the barrel of the pistol.

4 Claims, 1 Drawing Sheet

FIG. 1
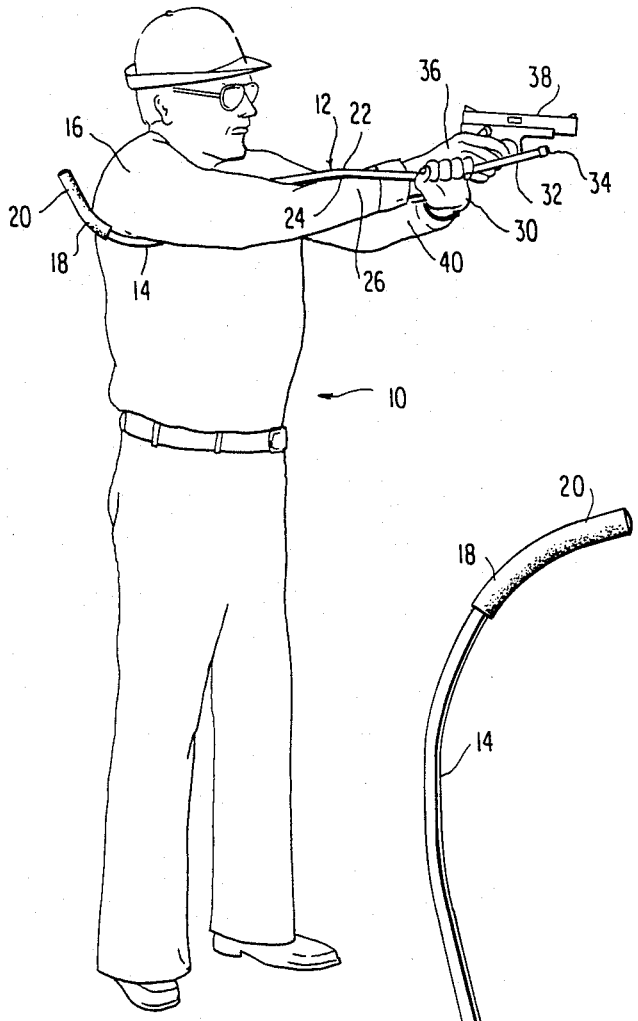
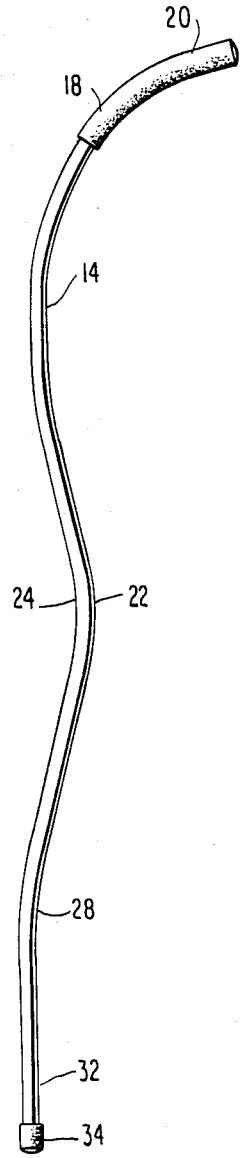
FIG. 2
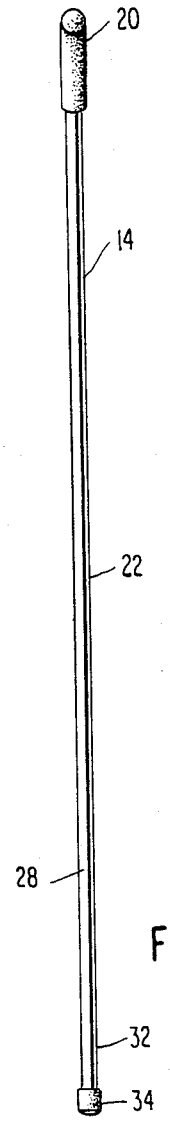
FIG. 3

PISTOL BRACE

BACKGROUND OF THE INVENTION

1. Field of the Invention

This invention pertains to a brace for supporting the arm and back of a shooter holding a pistol in his hand.

2. Background of the Prior Art

The prior art shows devices for assisting a pistol shooter in holding a pistol steady in the shooting stance. These devices are complex mechanical structures and require that the pistol be attached in some way to the devices. The present invention eliminates these infirmities by providing a simple yet efficient device which does not require that the pistol be attached to it.

Representative of the prior art are the following list of patents and copies are furnished for the file and consideration during prosecution of this application:

| Patentee | Patent No. | Title of Invention |
|---|---|---|
| R. J. Casull | 3,609,902 | Handgun Support |
| J. Y. Canon | 3,553,878 | Means For Supporting |
| H. C. Christensen | 3,200,528 | Device For Supporting a Pistol on a Belt |
| G. M. La Coss | 3,162,966 | Handgun Stabilizer |
| C. R. Keeran | 1,111,905 | Weapon |

SUMMARY OF THE INVENTION

There is a need for a simple yet efficient device for assisting a pistol shooter in holding steady a pistol in the shooting stance.

It is therefore one object of this invention to provide a simple structure which is easy and inexpensive to make yet greatly facilitates and assists the user in holding a pistol steady.

It is another object of this invention to provide such a device which has a hook at one end wrapped with foam rubber for positioning under the shoulder and held with the hand to provide a rigid support for the shooter's back and both arms.

It is still another object of this invention to provide such a device in the nature of a single elongated member having a bend for receiving the upper arm near the shoulder of a shooter and having a second bend distal from the first bend for resting on the upper forearm of a shooter and a third yet further bend for gripping by the other hand of the shooter.

These and other objects of the invention will become apparent to those skilled in the art to which the invention pertains from a reading of the following specification when taken in light of the annexed drawings.

BRIEF DESCRIPTION OF THE DRAWINGS

FIG. 1 is a perspective view of a shooter with the device of the invention tucked under the shoulder with the right arm entwined in the device and over the left arm whose hand grips the device at the distal end.

FIG. 2 is a perspective view of the device in elevation and shows the hooked bend with rubber wrapping, the hooked bend and a second bend permitting the shooters right arm to entwine the device, and a third bend for permitting the shooter's left hand to grasp the device at the distal end whereby the shooter's wrist, both shoulders and back are firmly braced.

FIG. 3 is a front view of the device in elevation.

DESCRIPTION OF THE PREFERRED EMBODIMENT OF THE INVENTION

Referring now in more detail to FIG. 1, there is shown a shooter 10 in the shooting stance. The device 12 of the invention is shown to be an elongated rod having a depending hooked bend or looped portion 14 tucked beneath the shoulder 16 of the shooter 10. The device 12 is provided with a hooked end 18 which is wrapped with any suitable soft wrapping material 20 such as rubber or the like. It will be appreciated that the hooked end 18 is provided to grasp the shoulder 16 thus providing a brace therefor. Forward of the looped portion 14 is a raised portion 22 which defines a second elevated looped portion 24 which extends over the forearm 26 of the shooter. Forward of the raised portion 22 and looped portion 24 is a third smaller looped portion 28 which is gripped by the left hand 30 of the shooter 10. The distal end 32 of the device 12 is perfectly straight and has a end 34. As is evident, the wrist of the right hand 36 holding pistol 38 is firmly locked on the wrist 40 of the left hand thus providing a pistol brace to rigidly support the shooters back and both arms whereby the pistol 38 is held steady in the shooting stance. The device 12 may be manufactured from any suitable durable material.

The novelty of the device is enhanced by its use as a walking cane for the shooter 10.

While the invention has been described with respect to a preferred embodiment thereof, it will be appreciated by those skilled in the art to which the invention pertains that numerous changes may be made in the invention without departing from the spirit and scope thereof.

What is claimed is:

1. A pistol brace comprising an elongated rod having:

adjacent one end thereof a first bend means curved in a direction for engaging the underside of one shoulder of a shooter;

a hooked portion means, at said one end of said rod, curved in the same said direction for engaging the back of the shoulder;

a second bend means, spaced from said first bend means in a direction toward the opposite end of said rod, for resting on the shooter's forearm which is on the same side of the shooter's body as said one shoulder;

a third bend means, spaced from said second bend means in the direction toward said opposite end of said rod, for supporting the shooter's hand which is on the opposite side of the shooter's body; the respective spacings between said first, second and third bend means being such that, when the shooter's wrist on said same side of the body rests on the opposite wrist, said pistol brace provides a rigid support for a pistol held in the shooter's hand on said same side of the body; and a straight end portion extending between said third bend means and said opposite end of said rod.

2. A pistol brace as defined in claim 1 wherein said elongated rod has a longitudinal axis, and wherein said first, second and third bend means are bent away from said axis, said first and third bend means being bent away in the direction opposite that of said second bend means, there being only three bends in the entire elongated rod.

3. A pistol brace as defined in claim 1 or 2, wherein said hooked portion means is wrapped with yieldable material for cushioning the hooked portion means against the shoulder of a shooter.

4. A pistol brace as defined in claim 3 wherein said yieldable material is rubber.

* * * * *